United States Patent [19]

Masterman et al.

[11] 3,992,131

[45] Nov. 16, 1976

[54] LOW SPEED PUMP

[75] Inventors: James I. Masterman; James C. Solie; Jan H. Boers; Samuel B. McClocklin, all of Owatonna, Minn.

[73] Assignee: Owatonna Tool Company, Owatonna, Minn.

[22] Filed: Mar. 17, 1975

[21] Appl. No.: 559,311

[52] U.S. Cl. ..... 417/206

[51] Int. Cl.[2] ..... F04B 23/12

[58] Field of Search ..... 417/205, 206

[56] References Cited

UNITED STATES PATENTS

| | | | |
|---|---|---|---|
| 3,380,392 | 4/1968 | Boers | 417/206 |
| 3,548,715 | 12/1970 | Bobst | 417/206 |
| 3,614,267 | 10/1971 | Schultze | 417/206 |

*Primary Examiner*—William L. Freeh
*Assistant Examiner*—G. P. LaPointe
*Attorney, Agent, or Firm*—Wegner, Stellman, McCord, Wiles & Wood

[57] ABSTRACT

A two-stage pump assembly employs a rotary-type gerotor pump combined with a reciprocating axial piston-type pump both mounted on and driven by a common shaft of a motor. A single key drivingly connects the rotor of the gerotor pump and the angle plate of the axial piston pump to the shaft of the motor for simultaneous operation of the two pumps. A wear sleeve is seated on the shaft of the motor and coacts with an oil seal carried by a common wall between the motor and the gerotor housing to prevent leaking of the fluid being pumped.

3 Claims, 1 Drawing Figure

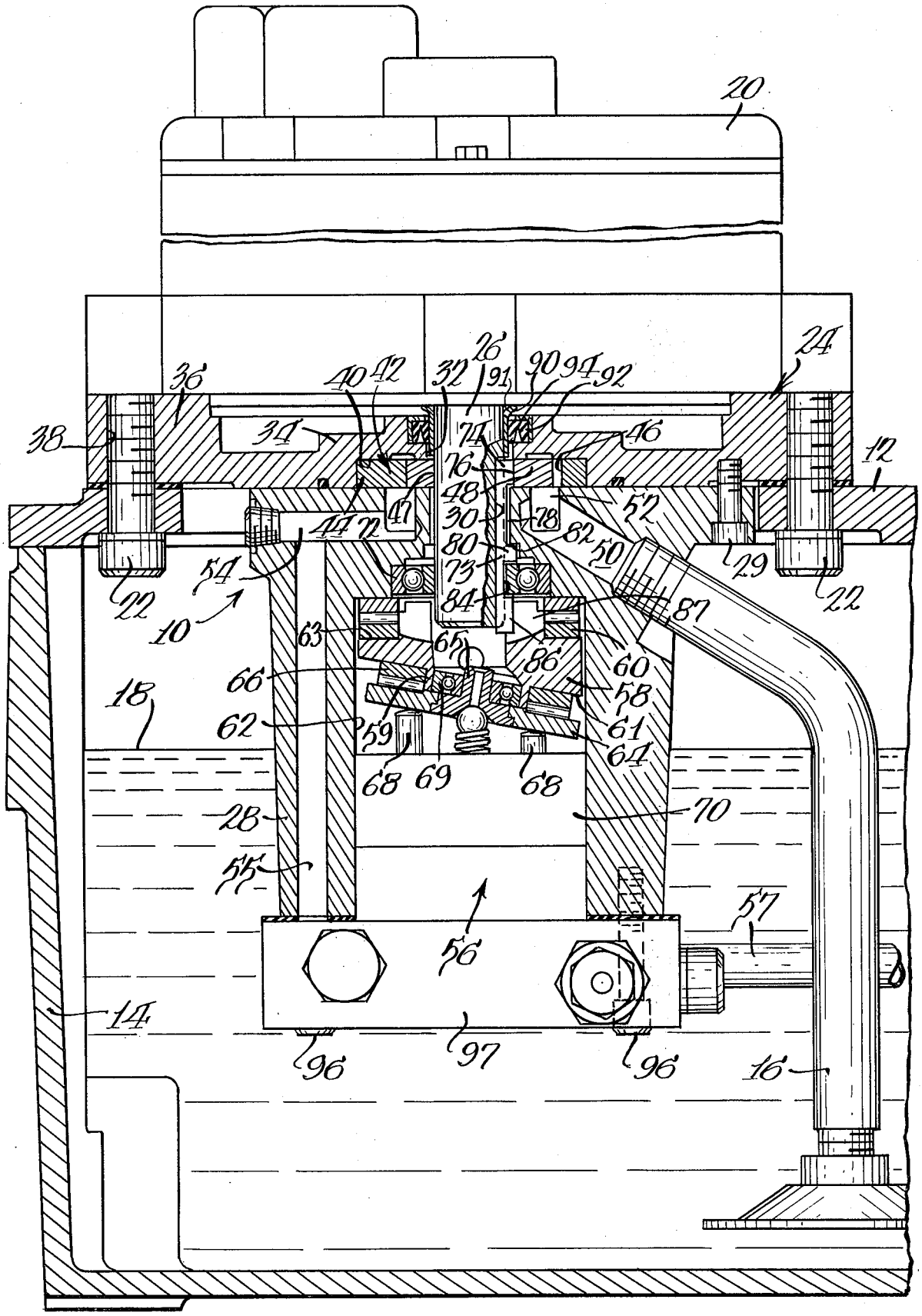
20
24
26
36
40
42
32
91
90
94
92
38
34
74
46
12
76
48
52
47
30
78
44
72
82
50
80
29
54
73
22
22
10
84
87
63
65
86
60
66
58
18
62
59
61
64
68
69
68
28
70
55
57
56
14
96
97
96
16

LOW SPEED PUMP

BACKGROUND OF THE INVENTION

1. Field of the Invention

This invention relates to the field of pumps and, more particularly, to low speed two-stage motor driven pumps.

2. Description of the Prior Art

There are many uses for a pump capable of delivering either a small volume of fluid at a relatively high pressure or a large volume of fluid at a relatively low pressure. Known two-stage fluid pumps are capable of producing the desired outputs. One such known two-stage pump is shown in U.S. Pat. No. 3,614,267 to Schultze wherein a gerotor pump and a radial piston pump are driven by a shaft that telescopes over the motor output shaft. The radial pistons of the radial piston pump are driven successively by a sidewardly facing cam on the output shaft. The uneven radial forces created by the radial pistons have a tendency to cause deflection of the shaft and wear in the bearings supporting the shaft of the motor. The deflection of the shaft also causes the shaft seals to leak with the attendant problems.

U.S. Pat. No. 3,053,186 to Gondek is also directed to two-stage pumps with a gear pump driven directly by the motor shaft and with a wobble plate pump being driven by a shaft connected to the driven gear of said gear pump. The Gondek pump is expensive to build and to maintain, requiring two shafts and mountings therefor. Since Gondek requires two shafts and associated bearings, the resulting pump is bulky and awkward to use.

SUMMARY OF THE INVENTION

The present invention is directed to a two-stage fluid pump having a motor for driving both stages from a single output shaft. One stage of the pump is a gerotor pump having the inner rotor mounted directly on the motor shaft. The second stage of the pump is a wobble plate or angle plate-type pump with the angle plate being mounted on and driven by said motor shaft. A single key locks both the rotor of the gerotor pump and the angle plate of the angle plate pump to said motor shaft for simultaneous driving of both pumps. A wear sleeve is seated about the motor shaft between the rotor of the gerotor pump and the motor housing to improve fluid sealing between the pump and the motor. The wear sleeve is easily replaced when repair is necessary.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a partial sectional view through the midportion of the improved two-stage pump with some parts in section.

DESCRIPTION OF THE PREFERRED EMBODIMENT

Referring to the drawing, a two-stage fluid pump 10 is mounted on a cover plate 12 of a reservoir or fluid containing chamber 14 with an intake tube 16 of the pump extending down into the fluid 18 in the reservoir.

The two-stage pump 10 is driven by a motor 20 bolted at 22 to a combination low-pressure pump housing and motor mount 24 and to the cover plate 12. The motor 20 has a shaft 26 projecting through said combination housing and mount 24 and into a high-pressure pump housing 28. The high-pressure pump housing 28 is bolted to the low-pressure pump housing 24 by means of bolts 29, only one of which is shown.

The motor 20 is a standard end mounted motor with an axially extending keyway 30 formed in the side wall of the shaft 26. The shaft 26 projects through aperture 32 formed in the center portion 34 of the housing and motor mount 24. The housing and motor mount 24 has an axially and radially enlarged outer rim 36 which engages with the ends of the side walls of the motor and through which rim 36 openings 38 are formed for passing the mounting bolts 22 from the cover plate 12 to the motor. The center portion 34 of the housing and motor mount 24 has a cavity 40 in which is mounted the operating parts of a low-pressure pump 42. The pump 42 is shown as a conventional gerotor pump having an outer rotor 44 with a pumping chamber 46 in which is rotatably positioned an inner rotor 48. The shaft 26 of the motor passes through an opening 47 in the inner rotor 48 and is keyed to said rotor in a manner to be more fully described hereinafter. The intake tube 16 is supported in the high-pressure pump housing 28 and has a passage 50 in communication with the inlet 52 of the low-pressure pump 42. The pump 42 may be a high volume, low-pressure positive displacement pump such as the type sold by W. H. Nichols Company of Waltham, Massachusetts, as, for instance, a Type 6063. The outlet 54 of the low-pressure pump 42 is connected both to the inlet 55 of a high-pressure pump 56 and to a discharge conduit 57 so that the high volume of fluid can feed into the inlet of the high-pressure pump 56 and can unload the balance of the fluid either to the discharge conduit 57 or back into the reservoir 14.

Mounted in the high-pressure pump housing 28 is the reciprocating axial piston high-pressure pump 56 which has an angle plate 58 keyed to the shaft 26 in a manner to be described hereinafter. The angle plate 58 has an outer axially facing surface 63 in which is seated the lower raceway of bearing 60 with the other raceway being urged against the roof of the cavity 62 in the housing 28. The lower surface 61 of the angle plate 58 is disposed in a plane which lies at an angle to the axis of the shaft 26 and has an axially projecting sleeve 59 centrally disposed thereon. A contact plate 64 is urged against bearing 66 riding on the lower surface 61 of the angle plate 58 and engages with the ends of a plurality of axially movable pistons 68 in the pump body 70. The contact plate 64 has a centrally disposed apertured post 65. A radial load bearing 69 encircles said post 65 and is seated in said sleeve 59 on the angle plate 58 to receive the radial load exerted by pistons 68 on plate 64. The angle plate, high-pressure pump 56 is a conventional, commercially available pump. The valving and porting of the pump 56 is conventional also, so that the charge of fluid from the low-pressure pump 42 is received at the intake 55 and, through the action of the axial pistons 68 has its pressure increased. A high-pressure, low volume flow of fluid is discharged from pump 56 into the discharge conduit 57.

The high-pressure, angle plate pump 56 is mounted centrally on the lower end of the motor shaft 26 so as to minimize loading on the shaft. Due to the radial loads exerted by the angle plate 58, radial bearing 72 is mounted in the housing 28 about the lower portion of the motor shaft 26.

The inner rotor 48 of the low-pressure gerotor pump 42 and the angle plate 58 of the high-pressure pump 56, are both keyed to the shaft 26 by means of an elongate single key 73 seated in the keyway 30 in said shaft. Specifically, the key 73 has an outwardly projecting portion 74 which seats in a slot 76 in the inner rotor 48 of pump 42. The key 73 has a reduced radial portion 78 between said portion 74 and a guide portion 80 which projects into recess 82 in the housing 28 surrounding said shaft 26. The key 73 has a second reduced radial portion 84 between said guide portion 80 and a second projecting portion 86 which portion 86 seats in a slot 87 in the angle plate 58 of pump 56. The bearing 72 seats between guide portion 80 of the key and projecting portion 86 and is assembled in a manner to be described hereinafter. The inner race of bearing 72 engages with guide portion 80 and projecting portion 86 of the key 73 to prevent axial sliding of the key 73 in the keyway 30. With the two pumps 42 and 56 keyed to the single shaft 26, the speed for the drives of the pumps is the same and, since no gearing or power transfer from one shaft to another is involved, the cost of manufacturing and the cost for maintaining the pumps is reduced to a minimum.

An oil seal is provided between the shaft of the motor and the housing of motor mount 24. This is accomplished by providing a tight fitting sleeve 90 about the shaft with a flanged end 91 of the sleeve, which flanged end 91 is used for pressing the sleeve on the shaft, being disposed in close proximity to the support portion of the motor. A recess 92 is formed concentrically around the opening in the motor mount 24 with a shaft oil seal 94 seated in said recess 92. The shaft oil seal 94 engages with the sleeve 90 to prevent fluid from seeping from the pump 42 into the motor housing. The sleeve 90 is sold commercially by the Chicago Rawhide Mfg. Company and is known under the trade name "Speedi-Sleeve". In use, in the event the seal between the sleeve 90 and the seal 94 begins to leak, due to wear on the sleeve, it is a simple matter to remove and replace the "Speedi-Sleeve" 90 whereupon the seal is again effective without requiring the usual machining of the shaft as was previously necessary.

To assemble the pump unit, the motor 20 is stood on end with the shaft 26 projecting upwardly. The "Speedi-Sleeve" 90 is force fit onto the shaft 26. The housing or motor mount 24 is then positioned over the shaft with the oil seal 94 bearing against the sleeve 90. The gerotor pump 42 is then positioned in the cavity 40 in the housing 24.

In a separate preliminary operation, the radial bearing 72 is seated in the opening in the top of the cavity 62 of the high-pressure pump housing 28. The key 73 is inserted through the opening in the radial bearing 72 normally occupied by the shaft 26 and is positioned with the guide portion 80 in the recess 82 in the housing 28. The reduced radial portion 84 of the key is positioned with respect to the radial bearing 72 such that the guide portion 80 and projecting portion 86 of the key 73 are engaged with opposite axial sides of the inner raceway of the bearing 72, and the portion 78 and projecting portion 74 of the key project externally of the housing 28.

The housing 28 is then inverted and the key 73 is aligned with the slot 30 in the shaft 26. The key 73 is slid into the slot 30 as the housing 28 is moved toward the housing 24 with the projecting portion 74 of the key fitting into the slot 76 in the inner rotor 48 of the pump 42. The housing 28 is then bolted to the low-pressure housing 24 by securing bolts 29 in place. The bearing 60 and the angle plate 58 are then inserted in the cavity 62 in the housing 28 with the slot 87 in the angle plate engaging the projecting portion 86 of the key 73 and the bore of the angle plate 58 pilots onto the end of motor shaft 26. The bearing 66, bearing 69, contact plate 64, pistons 68 and pump body 70 of the high-pressure pump 56 are then assembled in the housing 28 with the plate 64 engaging thrust bearing 66, which in turn engages the surface 61 of the angle plate 58. The pistons 68 extending from the pump body 70 are also in contact with said contact plate. Bolts 96 are passed through the base plate 97 to secure the base plate to the housing 28. The bolts 22 are then passed through the cover 12 and housing 24 to connect the pumps to the motor 20. The two-stage pump and motor are then inverted and placed in the reservoir chamber 14.

We claim:

1. In a two-stage pump having a motor with an output shaft, a low-pressure pump housing adjacent said motor with said output shaft projecting through said low-pressure pump housing, a gerotor pump mounted in said low-pressure pump housing with the inner rotor of said gerotor pump being keyed to said output shaft, a high-pressure pump housing mounted to said low-pressure pump housing, an angle plate pump mounted in said high-pressure housing with the angle plate being keyed to said output shaft, a single separable elongate key on said output shaft providing said keying of both said inner rotor and the angle plate to said shaft and means on said key for retaining said key in position relative to said output shaft.

2. A two-stage pump having a motor mounted on a reservoir with an output shaft of said motor extending into said reservoir, a low-pressure pump housing mounted to said motor with said output shaft projecting through said low-pressure pump housing, a gerotor pump mounted in said low-pressure pump housing and having an inner rotor and an outer rotor, said outer rotor being driven by said inner rotor, a high-pressure pump housing adjacent said low-pressure pump housing, an angle plate pump mounted in said high-pressure housing and key means locking said inner rotor of said gerotor pump and the angle plate of said angle plate pump to said output shaft, said key means having a pair of spaced apart radially projecting portions engaging opposite sides of a raceway of a bearing supporting said output shaft for holding said key means in position on said shaft.

3. A two-stage pump having a motor with an output shaft, a low-pressure pump housing adjacent said motor with said shaft projecting through said low-pressure pump housing, a gerotor pump mounted in said low-pressure pump housing, a high-pressure pump housing mounted to said low-pressure pump housing, a bearing seated in one of said pump housings and rotatably supporting said output shaft, an angle plate pump mounted to said high-pressure housing, and a single elongate key seated in said output shaft and keying both said gerotor pump and said angle plate pump to said shaft, said key having a pair of spaced apart radially extending portions engaging on opposite sides of said bearing whereby said bearing holds said key against axial sliding movement relative to said output shaft.

* * * * *